US006840553B2

(12) United States Patent
Dirnberger et al.

(10) Patent No.: US 6,840,553 B2
(45) Date of Patent: Jan. 11, 2005

(54) APPARATUS FOR BLOCKING AND RELEASING A DOOR LOCK OF AN ELECTRICAL APPLIANCE

(75) Inventors: Albert Dirnberger, Neunburg (DE); Georg Spiessl, Willhof (DE)

(73) Assignee: Elektromanufaktur Zangenstein Hanauer GmbH & Co KGAA, Nabburg (DE)

( * ) Notice: Subject to any disclaimer, the term of this patent is extended or adjusted under 35 U.S.C. 154(b) by 0 days.

(21) Appl. No.: 10/016,526

(22) Filed: Dec. 10, 2001

(65) Prior Publication Data

US 2002/0101313 A1 Aug. 1, 2002

(30) Foreign Application Priority Data

Dec. 22, 2000 (EP) ..... 00128370

(51) Int. Cl.[7] ..... E05B 15/02

(52) U.S. Cl. ..... 292/341.16; 292/DIG. 69; 292/DIG. 65

(58) Field of Search ..... 292/341.16, DIG. 69, 292/341.17, DIG. 65

(56) References Cited

U.S. PATENT DOCUMENTS

| | | | | | |
|---|---|---|---|---|---|
| 4,074,545 | A | * | 2/1978 | Case | 68/12.26 |
| 4,109,637 | A | * | 8/1978 | Drouin | 126/197 |
| 4,111,474 | A | * | 9/1978 | Heydner | 292/144 |
| 4,286,811 | A | * | 9/1981 | Schantz | 292/201 |
| 4,351,288 | A | * | 9/1982 | Gasloli | 126/197 |
| 4,422,060 | A | * | 12/1983 | Matsumoto et al. | 335/256 |
| 4,718,705 | A | * | 1/1988 | Case | 292/201 |
| 4,917,414 | A | * | 4/1990 | Boulanger | 292/113 |
| 4,932,707 | A | * | 6/1990 | Ekstran | 292/108 |
| 5,012,794 | A | * | 5/1991 | Faurel | 126/197 |
| 5,241,292 | A | * | 8/1993 | Bjorknas et al. | 335/256 |
| 5,520,424 | A | | 5/1996 | Hapke et al. | |
| 5,823,017 | A | | 10/1998 | Hapke et al. | |
| 5,879,036 | A | * | 3/1999 | Moline et al. | 292/210 |
| 6,036,241 | A | * | 3/2000 | Ostdiek et al. | 292/229 |

FOREIGN PATENT DOCUMENTS

| | | |
|---|---|---|
| DE | 19601228 C2 | 7/1997 |
| EP | 0965677 A1 | 12/1999 |
| GB | 2080399 A | 2/1982 |

* cited by examiner

*Primary Examiner*—Robert J. Sandy
*Assistant Examiner*—Thomas Ho
(74) *Attorney, Agent, or Firm*—Woodard, Emhardt, Moriarty, McNett & Henry LLP

(57) ABSTRACT

The present invention provides an apparatus for blocking and releasing a door lock of an electrical appliance, such as e.g. a washing machine, a dishwasher or a tumble drier. In said apparatus, use is made of a blocking and release unit, which in a blocking state blocks the locked door lock in order to prevent unlocking of the door lock. In a release state the blocking and release unit enables unlocking of the door lock in that it releases the still locked door lock. Furthermore, an emergency release unit, which is constructed separately from the blocking and release unit, is used to bring the blocking and release unit automatically into the release state in an abnormal operating state of the electrical appliance, such as e.g. in the event of a power failure.

18 Claims, 11 Drawing Sheets

APPARATUS FOR BLOCKING AND RELEASING A DOOR LOCK OF AN ELECTRICAL APPLIANCE

FIELD OF THE INVENTION

The present invention relates to an apparatus for blocking and releasing a door lock or a door interlock for electrical appliances and in particular domestic electrical appliances. Specifically, the present invention relates to an apparatus, which allows a door lock or a door interlock of an electrical appliance, such as e.g. a washing machine, a dishwasher or a tumble drier, to be blocked during normal operation in order to prevent an undesirable unlocking or opening of the door lock or door interlock. The present invention moreover enables automatic, independent release of the door lock or door interlock for unlocking or opening when the electrical appliance is in an abnormal operating state.

BACKGROUND OF THE INVENTION

For safety reasons, it is required that the doors of electrical appliances and in particular of domestic electrical appliances, such as e.g. washing machines, dishwashers and tumble driers, may not be opened while an appliance is in operation. This is to prevent a user from being injured by rotating components of an electrical appliance, such as e.g. a drum of a washing machine or rotating arms of a dishwasher, if he attempts to open the appliance while in operation. It is also to prevent water or hot air from escaping because of an unintentional, even only partial opening of an appliance door.

For said purpose, locking or blocking apparatuses are usually used which, upon or after starting of an electrical appliance with a closed appliance door, lock a door lock or a door interlock for the appliance door in such a way that during the continuous operation of the electrical appliance the door of the latter may not be opened. In an operating state of the electrical appliance, in which it is intended that the appliance door may be opened, the door lock or the door interlock is released for opening. Such an operating state generally exists at the end of the actual operation of the electrical appliance (e.g. wash or drying programs). Such operating states may however also exist during the actual operation of the electrical appliance when opening of the appliance door may be effected without risk.

While the unlocking function of locking or blocking apparatuses may be provided during normal operation, unlocking of a door lock or a door interlock by means of such apparatuses is normally no longer possible when the electrical appliance, in a departure from desired operating states, is in an abnormal operating state. This is the case, for example, when there is a failure of the power supply for the electrical appliance, or the electrical appliance is not connected to an electrical power supply. Locking or blocking apparatuses, which prevent an undesirable opening of the appliance door of an electrical appliance during normal operation, are operated generally by means of electrical energy. Thus, a failure or absence of an electrical energy supply leads to an inability to open an appliance door which is secured or locked during normal operation by such an apparatus.

Prior Art

From DE 196 01 228 C2 it is known to lock the door of a washing machine or dishwasher during normal operation by means of an apparatus, which comprises a bolt nab or a door catch and a locking body. The locking body in an open position releases the bolt nab or the door catch for opening of the door, whereas in a closed position it prevents the bolt nab or the door catch from opening the door. To bring the locking body into the open position and the closed position a bistable element is used, which is preloadable into two positions by means of a force-generating element. In a first position the bistable element prevents a movement of the locking body out of its closed position into its open position. In a second position, on the other hand, the bistable element enables a movement of the locking body out of its closed position into its open position. The bistable element therefore provides the previously described locking and release function during normal operation of a washing machine or dishwasher.

The bistable element is moved into its first and its second position by means of two independent magnets, wherein for crossovers between the positions a snap point has to be overcome, which is provided by a spring used as the force-generating element. Furthermore, use is made there of a safety bolt, which by means of the bistable element arrests the locking body in its closed position and, for release of the locking body, is brought by the bistable element out of engagement with the locking body.

In order in an abnormal operating state of the washing machine or dishwasher, which is referred to as an emergency situation, to bring the locking apparatus described there into the open position for opening of the door, an emergency unlocking lever is provided. The emergency unlocking lever to be operated by a user moves the safety bolt in such a way that the latter is brought out of engagement with the locking body. Operation of the emergency unlocking lever may be effected e.g. by means of a cable pull or Bowden wire, which is normally run to a side wall or the base of the washing machine or dishwasher.

Said emergency unlocking device however also allows the appliance door to be openable during normal operation of the washing machine or dishwasher because a user may independently, through operation of the emergency unlocking lever, deactivate the safety measures provided by the locking apparatus against undesirable opening of the appliance door. A further drawback is that in an abnormal operating state of the washing machine or dishwasher the emergency unlocking is to be effected manually by a user. This is sometimes a complicated procedure because the cables used to operate the emergency unlocking lever are disposed at points which are difficult to access. It is moreover necessary for the user to be informed about how emergency unlocking is to be effected.

To eliminate the drawbacks of an emergency unlocking effected by a user, according to EP 965 677 A1 use is made of a locking apparatus, which comprises a blocking element, which is movable by means of a thermoelement, and a release element, which is movable by means of an electromagnet. During normal operation of a domestic appliance, in which said locking apparatus is used, the thermoelement is heated by supplying energy in such a way that it moves the blocking element into a blocking position, which locks a bolt nab or a door catch of an appliance door to prevent undesirable opening. If during normal operation of the domestic appliance an opening of the appliance door is to be permitted, the release element is moved by means of the electrically activated electromagnet in such a way that it brings the blocking element out of the blocking position into a release position. In the release position there is no working connection between the blocking element and the bolt nab or the door catch. During normal operation the blocking element is held in its blocking position by the thermoelement, which for suitable heating and the resultant positioning is supplied with electrical energy.

When there is no electrical energy available for operating the domestic appliance and hence for operating said locking apparatus, the thermoelement is also no longer heated. The thermoelement accordingly cools down and moves into its original position, with the result that the blocking element is no longer held in its blocking position but moves into its release position. In said manner, an emergency unlocking is provided, for which no measures are to be taken by a user.

The drawback here is that the thermoelement is used to bring the blocking element into the blocking position and hold it in the blocking position. Because of the time it takes to heat the thermoelement to such an extent that the blocking element is brought into the blocking position, said locking apparatus does not inevitably lock the appliance door at the same time as the domestic appliance is set in operation. Especially in domestic appliances, in which rotating components are used, this may constitute a danger. Because of the time delay before locking, a user may immediately after start-up of the domestic appliance open its door again and be injured by coasting rotating components. What is more, the thermoelement does not guarantee that the blocking element is held reliably in its blocking position because, for said purpose, it is necessary for the thermoelement to be heated by supplying energy to it during normal operation of the domestic appliance. Thus, for example, failure of the thermoelement or of its electrical supply may lead to the appliance door being releasable and hence openable during operation of the domestic appliance.

A further drawback of said locking apparatus is that the locking function and the release function are provided by separately constructed devices, namely the blocking element and the release element. This is constructionally complex and may lead to the blocking element and the release element cooperating in an undesirable manner, more precisely, being moved against one another. Furthermore, the release element has to overcome the forces, which are summoned up by the thermoelement for holding the blocking element in its blocking position, in order to bring the blocking element into the release position. This leads to a higher energy demand for release of the appliance door and may lead, e.g. as a result of wear phenomena, to damage of the thermoelement.

OBJECT OF THE INVENTION

The object of the present invention is to provide an apparatus, which reliably locks a door lock or a door interlock of an electrical appliance and in particular of a domestic electrical appliance during normal operation in order to prevent an undesirable opening of an appliance door and guarantees that the appliance door is automatically unlocked for opening when the appliance is in an abnormal operating state.

BRIEF DESCRIPTION OF THE INVENTION

For said purpose, the present invention provides an apparatus for blocking and releasing a door lock of an electrical appliance. The apparatus according to the invention comprises a blocking and release unit, which in a blocking state blocks the locked door lock of the appliance in order to prevent unlocking of the locked door lock. In a release state the blocking and release unit enables unlocking of the door lock by releasing the (still locked) door lock. The apparatus according to the invention further comprises an emergency release unit, which in an abnormal operating state of the appliance, such as e.g. a power failure, brings the blocking and release unit into the release state. In particular, for said purpose the emergency release unit is independently, automatically activated so that no measures are to be taken by a user.

The use of one unit for blocking and releasing the door lock enables a compact design of the apparatus according to the invention and avoids the previously described wear in known apparatuses. The emergency release unit guarantees that where necessary, i.e. generally in an abnormal operating state of the appliance, the door lock is released for opening or unlocking. Since the emergency release unit is preferably constructed separately from the blocking and release unit, the characteristics of their functions may accordingly be defined separately. For example, the length of time taken by the emergency release unit to bring the blocking and release unit into the release state may be defined in an application-specific manner, independently of the technical specifications of the blocking and release unit. Equally, the times and/or time ranges for the states of the blocking and release unit and for crossovers between said states may be defined independently of the construction of the emergency release unit.

In order to bring the blocking and release unit into the blocking state, a working connection to the door lock may be used, which during locking of the door lock, e.g. during closing of the appliance door, moves the blocking and release unit into the blocking state. Said state is preferably assumed substantially immediately after or simultaneously with the actual locking of the door lock. In said embodiment of the invention, components actuable in a controlled manner, such as e.g. electromagnetic or piezostrictive components, may be used to effect a crossover of the blocking and release unit into the blocking state. Furthermore, it is thereby guaranteed that upon the actual closing of the appliance door, i.e. upon locking of the door lock, the door lock is blocked.

In order to bring the blocking and release unit into the blocking state in dependence upon a setting in operation of the appliance, the blocking and release unit crosses over into the blocking state when as a result of operation of the appliance a state for the door lock exists, in which the latter is to be blocked. In said case, electrical controlled actuators, such as e.g. (miniaturized) electric drives, electromagnets or piezostrictively acting components, may be used. Said embodiment allows the door lock and hence the appliance door to be openable until the appliance is actually set in operation. It is moreover possible in said case to effect the crossover of the blocking and release unit into the blocking state with a time delay in relation to a setting in operation of the appliance. In said manner it is possible to effect the blocking of the door lock only when an opening of the appliance door is actually undesirable or actually dangerous. For example, in the case of a washing machine the door lock may be blocked only when the water in the washing machine has reached a level, at which opening of the washing machine door would cause an escape of water. In said manner it is possible to put further (forgotten) items of laundry into the washing machine even though a wash program has already started. At present, for such a topping-up the selected wash program normally has to be aborted, in which case water already introduced into the washing machine has to be removed (pumped out). Also, emergency unlocking devices operable manually by a user are often improperly used for said purpose.

Since during operation of the electrical appliance operating states may arise, in which opening of the appliance door is not dangerous or undesirable, the blocking and release unit assumes the release state in an operating state of the appliance which permits unlocking of the door lock and hence opening of the appliance door. Said crossover into the release state may therefore occur also during an non-completed operating cycle.

In order to bring the blocking and release unit from the blocking state into the release state, electric drives, electromagnets, piezostrictive actuators and the like may be used.

An actuator used for the crossover into the release state is preferably also used for a crossover from the release state into the blocking state.

The emergency release unit has an idle state and a working state, wherein upon a crossover from the working state into the idle state the blocking and release unit is brought into the release state.

The emergency release unit is accordingly in the working state when, during normal operation of the electrical appliance, the blocking and release unit is in its blocking state. In said case, the emergency release unit may be brought into the working state in that, through the use of a suitable working connection to the blocking and release unit, the emergency release unit is brought from the idle state into the working state when the blocking and release unit crosses over into its blocking state.

It is further provided that a crossover of the emergency release unit from the idle state into the working state is effected when the blocking and release unit is already in the blocking state or before the blocking and release unit is brought into the blocking state.

During normal operation of the electrical appliance the emergency release unit is preferably in the idle state when the blocking and release unit is in the release state. It is consequently provided that during normal operation of the electrical appliance the emergency release unit, in response to a crossover of the blocking and release unit from the blocking state into the release state, crosses over into the idle state. This may be effected, for example, by means of a working connection, preferably the previously described working connection between the emergency release unit and the blocking and release unit, so that the state crossovers of the units run off substantially in synchronism. Alternatively, the crossover of the emergency release unit into its idle state may occur in a controlled manner or in an uncontrolled manner with a time delay.

To effect a crossover of the emergency release unit from the idle state into the working state, said unit may comprise an actuator. In order in said case to bring the emergency release unit back into the idle state, a force-generating element constructed separately from the actuator, such as e.g. a spring, is used. When the electrical appliance is set in operation, the actuator is activated so that it brings (moves) the emergency release unit into the working state. If in a normal operating state of the electrical appliance the emergency release unit is to cross over into the idle state, the actuator is deactivated and the force-generating element effects the desired change of state. So that in an abnormal operating state of the electrical appliance the force-generating element may be activated for a crossover into the idle state, the actuator is to be disposed and/or a suitable type of actuator is to be used in such a way that an abnormal operating state of the electrical appliance also leads to deactivation of the actuator.

Alternatively it is provided that the emergency release unit preferably comprises one or, where necessary, more actuators, which effect(s) crossovers into the working state and into the idle state. In an embodiment of the apparatus according to the invention, the emergency release unit comprises an emergency energy supply device for the actuator, which effects a crossover into the idle state, or for the force-generating element. For a crossover into the idle state of the emergency release unit in an abnormal operating state of the electrical appliance the emergency energy supply device supplies energy to said actuator or to the force-generating element in order to activate the latter. The emergency energy supply device may also be used to activate the actuator or the force-generating element during normal operation of the electrical appliance, wherein it is generally provided that said energy supply is effected by means of devices, which are used during normal operation to supply energy to the electrical appliance.

The emergency release unit may further comprise an energy supply device which during normal operation of the electrical appliance supplies energy to the actuator, which effects a crossover into the working state, for activating said actuator. Depending on the manner, in which crossovers into the working and idle states are generated, said energy supply device may be constructed optionally or in addition to the emergency energy supply device. It is further provided that a combined energy supply component be used, which provides the functions of the emergency energy supply device and of the energy supply device.

The actuator(s) of the emergency release unit preferably comprise(s) a heat-sensitive, thermally actuable element such as e.g. a PCT element, elements with bimetallic components or a wax motor. In said case, the actuator is activated by supplying it with electrical energy in order to heat the heat-sensitive element. The change in the state or position of the actuator (movement of the actuator) caused by such heating is used by means of suitable working connections to corresponding movable components (not specified in detail here) of the emergency release unit for crossovers into the working state and/or the idle state. Of particular advantage, here, is the use of a wax motor on account of its high coefficient of thermal expansion.

Alternatively or additionally the actuator(s) may comprise an electric motor, an electromagnetic actuator or at least one magnet.

In order to provide the energy needed for a crossover into the idle state without an external energy supply, the emergency energy supply device may comprise a capacitor, a battery, a solar cell or combinations thereof. In said case, it is to be preferred that the emergency energy supply device during normal operation of the electrical appliance absorbs and/or stores energy in order to provide said energy in an abnormal operating state.

As mentioned initially, operating states may exist for the electrical appliance, which differ from normal operating states and additionally make it necessary to prevent an unlocking of the door lock and an opening of the appliance door. One example of this is a washing machine, in which operation is interrupted because of a power failure and the water level in the drum is so high that water would escape if the appliance door were opened. In said situation, a release of the door lock by the emergency release unit should be prevented. To said end, the apparatus according to the invention comprises a release device for the emergency release unit, which in dependence upon parameters characterizing an abnormal operating state of the electrical appliance enables a crossover of the emergency release unit into its idle state. The parameters for controlling the release device may, in the event of availability of an electrical energy supply, e.g. the emergency energy supply device and/or the energy supply device of the emergency release unit, be provided electrically or by means of a mechanical arrangement (e.g. floats for detecting the water level).

BRIEF DESCRIPTION OF THE DRAWINGS

In the following description of preferred embodiments reference is made to the accompanying drawings, which show.

DESCRIPTION OF PREFERRED EMBODIMENTS

Figure 1A:
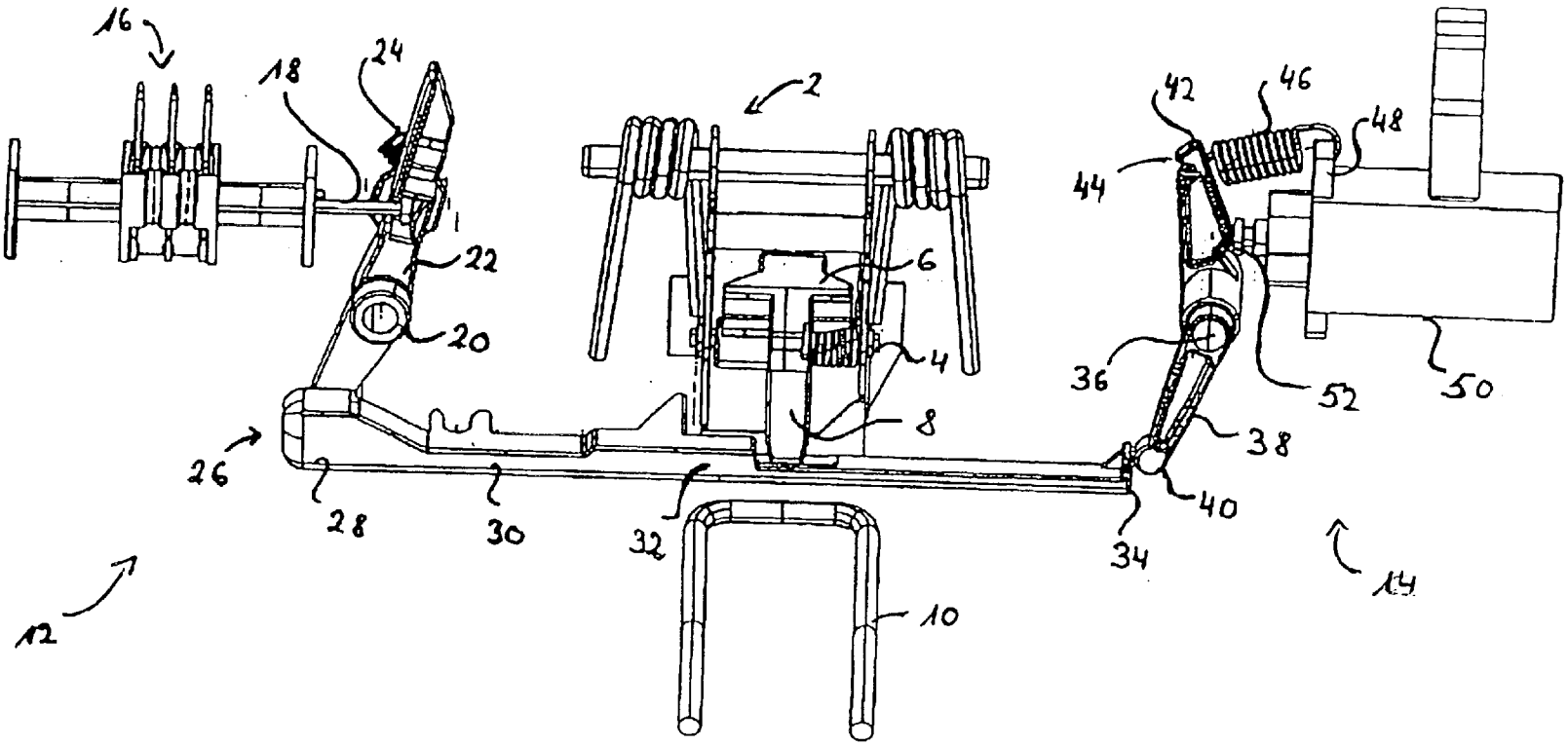
FIGS. 1*a*–1*d* an embodiment of the apparatus according to the invention, FIGS. 2*a*–2*d* a further embodiment of the apparatus according to the invention, FIG. 3 a diagrammatic view of a connecting link guide used in the embodiment of FIGS. 2*a*–2*d*, FIGS. 4*a*–4*f* a further embodiment of the apparatus according to the invention, and FIG. 5 a perspective view of a connecting link guide used in the embodiment of FIGS. 4*a*–4*f*.

FIGS. 1*a* to 1*d* show a known door lock 2 having a gripping device 6, which is rotatable about an axle 4 and has a latch 8 formed therein. The latch 8 cooperates with a bolt nab 10 in such a way that a movement of the bolt nab 10 during closing of a non-illustrated appliance door rotates the gripping device 6 in such a way that the door lock 2 is locked. During opening of the appliance door, a corresponding movement of the bolt nab 10 rotates the gripping device 6 in an opposite direction of rotation to that during closing, with the result that the door lock 2 is unlocked.

FIGS. 1*a* to 1*d* moreover show components 14 to 34 of a blocking and release unit 12 and components 36 to 52 of an emergency release unit 14 for an embodiment of an apparatus for blocking and releasing the door lock 2. The components of the blocking and release unit 12 and of the emergency release unit 14 are described with reference to FIG. 1*a*. For the description of the operation of said embodiment reference is made to FIGS. 1*a* to 1*d*.

The blocking and release unit 12 comprises an electromagnetic actuator 16 and a magnetic plunger 18 movable by the latter. According to FIGS. 1*a* to 1*d* the magnetic plunger 18 is movable to the left and to the right. The magnetic plunger 18 engages into one end of a lever 22, which is rotatable about an axle 20. The lever 22 is a bistable element, which may be preloaded by a spring 24 into two positions, which are described below. The spring 24 here is moreover disposed in such a way that forces needed for crossover of the lever 22 between its positions are provided at least partially by the spring 24. This is achieved in that potential energy stored in the spring 24 during a movement of the lever 22 is converted, after a snap point is overcome, into kinetic energy in order to provide forces in the original direction of motion of the lever 22.

Designing the lever 22 as a bistable element reduces the energy required for the electromagnetic actuator 16 because the electromagnetic actuator 16 is not needed to hold the lever 22 in one of the positions. On the other hand, the lever 22 may alternatively be a conventional lever if the electromagnetic actuator 16 and/or the magnetic plunger 18 and/or other non-illustrated devices guarantee that the lever 22 assumes and maintains positions which, as is described below, are necessary for the operation of the blocking and release unit 12.

An end of the lever 22 lying opposite the end workingly connected to the magnetic plunger 18 is connected by means of a hinged connection 26 to an end 28 of a blocking and release element 30. The blocking and release element 30, which here takes the form of a slide, has a blocking surface 32 in the region of the door lock 2. An end 34 lying opposite the end 28 is used for actuation of the blocking and release element 30 by means of the emergency release unit 14 in order that in an abnormal operating state of an electrical appliance, the appliance door of which may be locked and unlocked by means of the door lock 2, the blocking and release unit 12 may, in the manner described below, release the door lock 2 for unlocking.

The emergency release unit 14 comprises a lever 38, which is rotatable about an axle 36 and which in the event of abnormal operation of the electrical appliance may with one end 40 by virtue of a working connection to the end 34 actuate the blocking and release unit 12. An end 42 lying opposite the end 40 has a nose 44, which is used for fastening one end of a tension spring 46. The other end of the tension spring 46 is fastened to an attachment flange 48, which according to FIGS. 1*a* to 1*d* is provided on a housing (not denoted) of a heat-sensitive, thermally activatable actuator 50. Instead of the attachment flange 48 it is possible to use a different fastening element, which is provided e.g. on a frame for individual, some or all of the components shown in FIGS. 1*a* to 1*d*.

The actuator 50 here comprises a wax motor, which is used on account of its high coefficient of thermal expansion. The actuator 50 may be heated by supplying electrical or thermal energy, wherein the wax expands in order to move a displaceable member 52 connected thereto. In dependence upon a position of the displaceable member 52 caused by activation of the actuator 50 a working connection to the lever 38 may be established in order to enable the "emergency" release, described below, of the door lock 2 in an abnormal operating state of the electrical appliance.

In the view shown in FIG. 1*a*, the appliance door is open and so the bolt nab 10 is not in engagement with the latch 8. The door lock 2 is accordingly unlocked. Furthermore, the blocking and release unit 12 is in a release state and the emergency release unit 14 is in an idle state.

In said case, the lever 22 is held by the spring 24 in the position for the release setting, with the result that the blocking and release element 30 and in particular the blocking surface 32 are so positioned that, for closing and locking the appliance door, the bolt nab 10 may be introduced into the latch 8 and the gripping device 6 may be rotated.

In the idle state of the emergency release unit 14 the actuator 50 is not activated, with the result that the displaceable member 52 is situated in the neutral position shown in FIG. 1*a*. The tension spring 46 holds the lever 38 in the position shown there, wherein the displaceable member 52 and/or the end 34 serve as a stop for the lever 38. Such a stop may alternatively be provided by a separately constructed stop element (not shown). Given the use of such an external stop for the lever 38, contact of the latter with the displaceable member 52 and/or the end 34 in the position shown in FIG. 1*a* is not necessary but is established only, as described below, by a movement of the blocking and release element 30 and/or of the displaceable member 52. When upon closing of the appliance door the bolt nab 10 by virtue of rotation of the gripping device 6 locks the door lock 2, the position of the door lock 2 and of the bolt nab 10 shown in FIG. 1*b* arises. In order to secure the door lock 2 against non-permitted/undesirable unlocking, the blocking and release unit 12 is activated to block the door lock 2 or, more precisely, to prevent rotation of the gripping device 6. In said case, it is provided that the blocking and release unit 12 is actuated substantially immediately at the same time as locking of the door lock 2, after a defined length of time or in dependence upon an operating state of the electrical appliance.

Figure 1B:
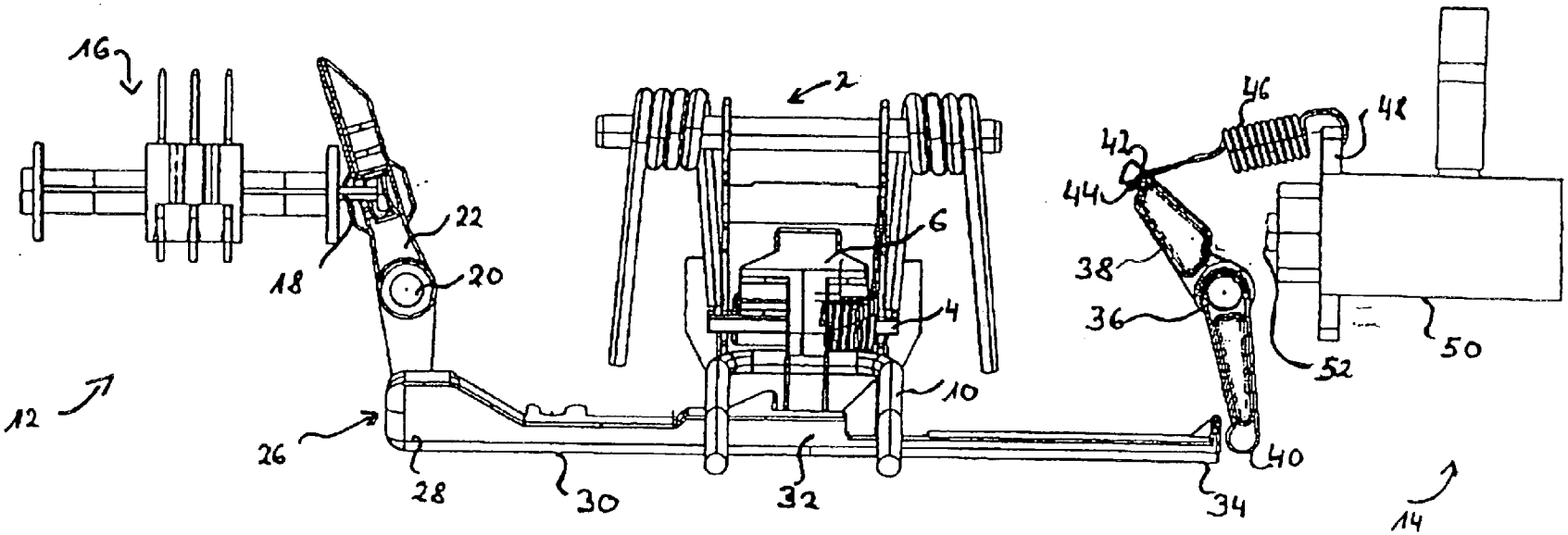

In order to actuate the blocking and release unit 12, i.e. assume the position shown in FIG. 1*b*, at the time, at which the door lock 2 is to be blocked, the electromagnetic actuator 16 is activated. The magnetic plunger 18 is therefore moved, in FIG. 1*b*, to the left so that the lever 22 is rotated about the axle 20 into the position shown there and is held in said position by the spring 24 and/or the magnetic plunger 18.

The rotation of the lever 22 effects a displacement of the blocking and release element 30 to the right, with the result that the blocking surface 32 assumes a position, which prevents a rotation of the gripping device 6 needed to unlock the door lock 2. In said case, depending on the respective manufacturing tolerances minor movements of the gripping device 6 may still be possible but rotations, which are required for actually unlocking the door lock 2, are prevented by the blocking surface 32.

The movement of the blocking and release element 30 to the right rotates the lever 38 anticlockwise because of contact of the end 34 with the end 40. This leads to an excursion of the tension spring 46. The position of the displaceable member 52 in said case has not altered compared to the position shown in FIG. 1*a*. The reason for this is that in said state the actuator 50 has not yet been activated or the supply of energy has not yet effected the change of the heat-sensitive actuator 50 needed for actuation of the displaceable member 52.

In the present case, the actuator 50 may be activated, i.e. supplied with energy, substantially at the same time as the electromagnetic actuator 16 or after a defined time delay.

Alternatively it is provided that the actuator 50, prior to activation of the electromagnetic actuator 16, is activated in such a way that, prior to a displacement of the blocking and release element 30, the displaceable member 52 is displaced to the left. In said case, the lever 38 may assume the working position shown in FIG. 1*b* prior to an actuation by the blocking and release unit 12.

Figure 1C:
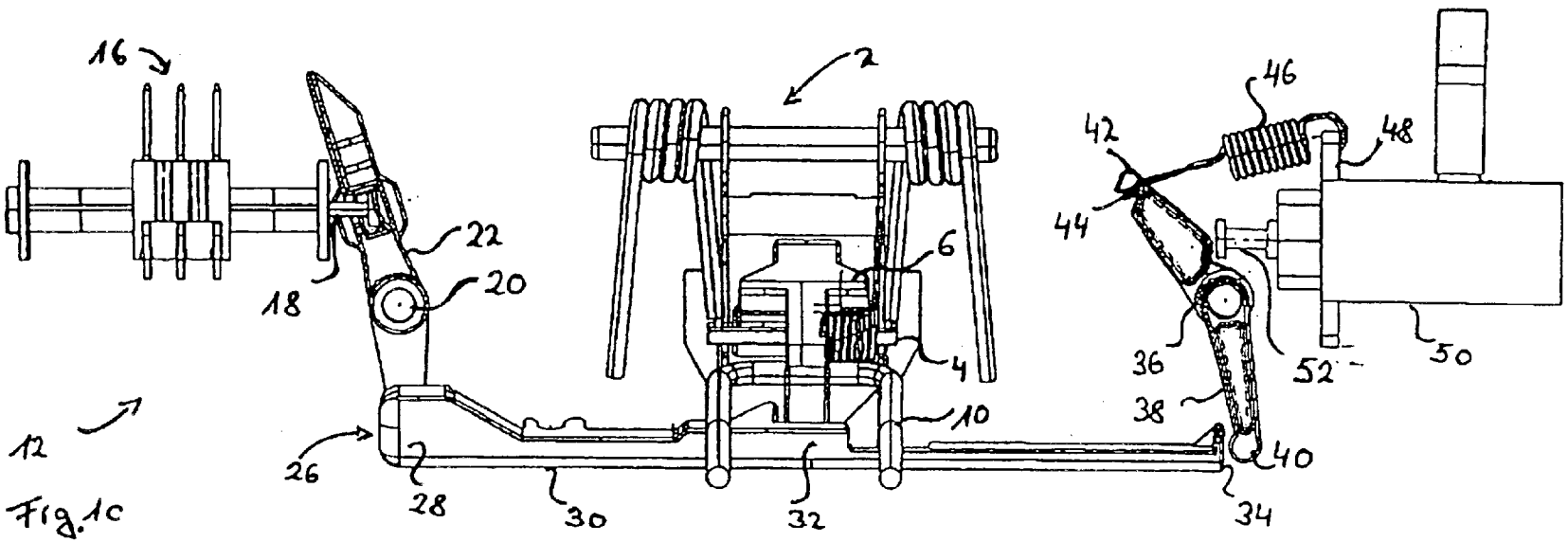

Once the blocking and release element 30 has been moved in the previously described manner to the right and the actuator 50 has been heated such that the displaceable member 52 is moved to the left, the state illustrated in FIG. 1*c* arises. In said state, the door lock 2 is locked and blocked by virtue of the blocking and release unit 12 being in a blocking state, wherein the displaceable member 52 contacts the lever 38. In said case, the state—referred to hereinafter as the working state—of the emergency release unit 14 and in particular the position of the displaceable member 52 are maintained in that the actuator 50 remains activated, wherein the energy needed for said purpose may be supplied continuously or at predetermined times and/or during predetermined periods of time.

Figure 1D:
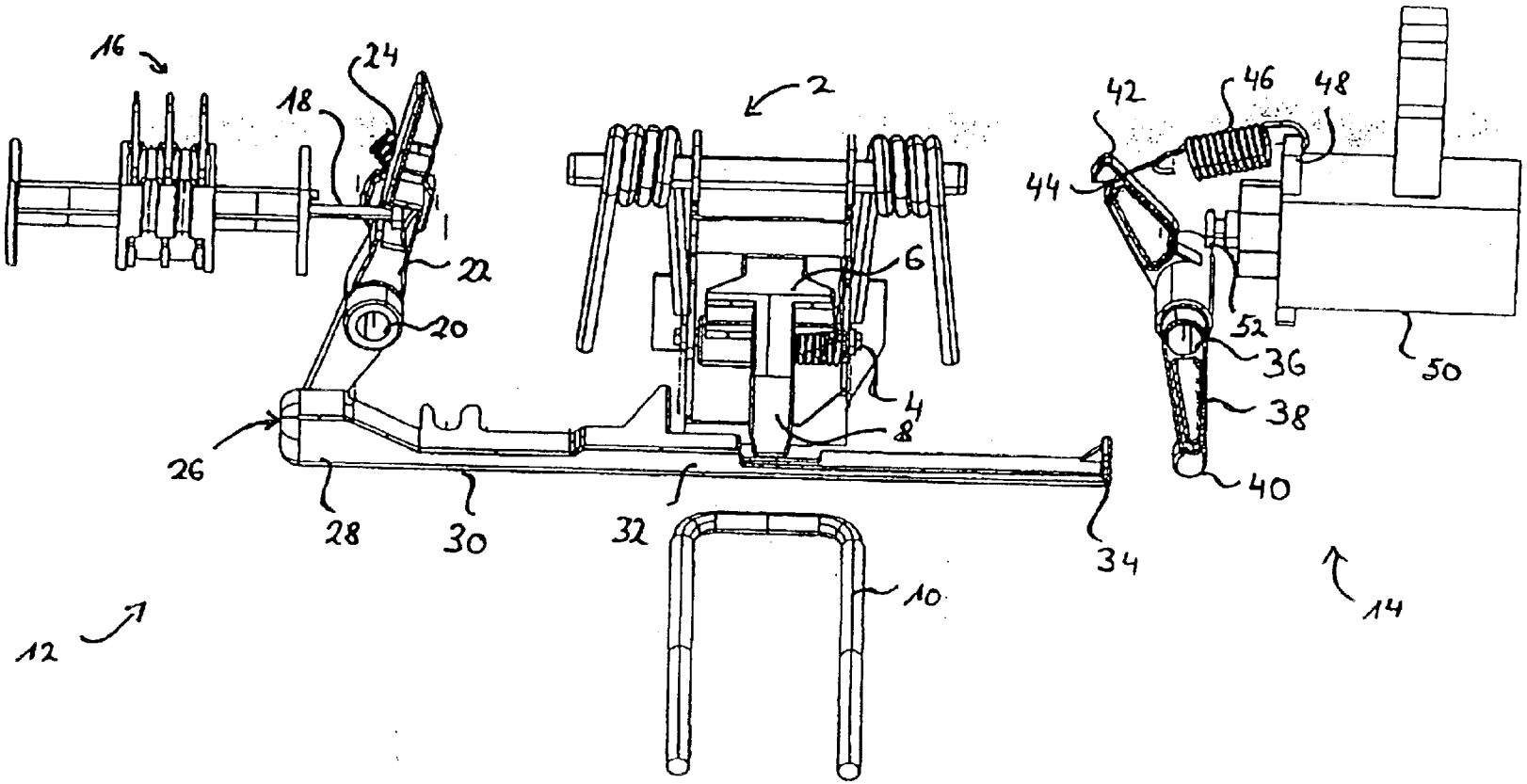

When in a normal operating state of the electrical appliance the appliance door is to be opened again, the electromagnetic actuator 16 is actuated in such a way that the magnetic plunger 18 is moved to the right. The lever 22 with the participation of the spring 24 is therefore rotated into the position shown in FIG. 1*d* and held there by the spring 24. Consequently, because of the hinged connection 26 the blocking and release element 30 is displaced to the left. The blocking surface 32 therefore assumes a position, in which it is possible, by virtue of opening of the appliance door and the movement of the bolt nab 10 caused thereby, to rotate the gripping device 6 and therefore unlock the door lock 2. Such a state, in which the blocking and release unit 12 is situated in its release state, the door lock 2 is unlocked and there is no working connection between the bolt nab 10 and the latch 8, is shown in FIG. 1*d*.

Substantially at the same time as the activation of the electromagnetic actuator 16 needed for release, the energy supply for the actuator 50 is interrupted/terminated. In the absence of the energy supply the actuator 50 cools down and so the displaceable member 52 is moved to the right. The time needed for such a cooling process means that the displaceable member 52 is still in the working position shown in FIG. 1*d*, which corresponds to the position in FIG. 1*c*, when the blocking and release unit 12 has already crossed over into its release state.

When upon cooling of the actuator 50 the displaceable member 52 moves to the right, the tension spring 46 in dependence upon the movement of the displaceable member 52 effects a rotation of the lever 38 in clockwise direction. The emergency release unit 14 therefore crosses over into its idle state, with the result that the state shown in FIG. 1*a* is reattained.

In an abnormal operating state of the electrical appliance, in which the change of state of the blocking and release unit 12 needed to release the door lock 2 cannot be provided, e.g. because of a power failure, the release of the door lock 2 is effected by means of the emergency release unit 14.

When such an abnormal operating state arises, the energy supply of the actuator 50 is interrupted. Said interruption of the energy supply may be effected in a controlled manner when devices, which are not shown here, detect an operating state, in which it is no longer possible to actuate the blocking and release unit 12 for release of the door lock 2. In the event of a power failure or no energy supply for the electrical appliance, the interruption of the energy supply for the actuator 50 is effected automatically.

As described above with reference to FIG. 1*d*, because of the missing energy supply the actuator 50 cools down, with the result that the displaceable member 52 is no longer held in the position shown in FIGS. 1*c* and 1*d*. This leads to a clockwise rotation of the lever 38 under the action of the tension spring 46. In contrast to the state shown in FIG. 1*d*, in said situation the blocking and release unit 12 is situated in its blocking state shown in FIGS. 1*b* and 1*c*. Consequently, the rotation of the lever 38 effects a displacement of the blocking and release element 30 because of the working connection between the end 40 and the end 34. Said displacement effects a crossover of the blocking and release unit 12 from its blocking state into its release state. As a result, by means of the emergency release unit 14 the state shown in FIG. 1*a* is attained, in which the door lock 2 may be unlocked and the appliance door may be opened.

In a non-illustrated variant of the embodiment of FIGS. 1*a* to 1*d*, instead of the actuator 50 and the tension spring 46 an actuator comprising a heat-sensitive element is used, which at least in abnormal operating states of the electrical appliance in a manner comparable to the tension spring 46 generates forces, which rotate the lever 38 in the previously described manner in order to bring the blocking and release unit 12 into its release state. In said case, such an actuator may be disposed in such a way that in an abnormal operating state of the electrical appliance it may introduce forces capable of rotating the lever 38 into the end 42 of the latter. In said case, it is possible to use an actuator, which in a manner comparable to the tension spring 46 cooperates with the end 42 and, in the event of interruption of the energy supply and the resultant cooling, rotates (pulls) the lever 38 in clockwise direction. In particular, it is possible here to use an actuator with a wax motor which, in contrast to the previously described wax motor, given a supply of electrical or thermal energy moves ("pulls into the actuator") an actuating member (comparable to the displaceable member 52) in an opposite direction to the previously described movement of the displaceable member 52 upon activation of the actuator 50. A deactivation of said actuator, i.e. an interruption of the energy supply, will accordingly move the actuating member in a direction, which substantially corresponds to the direction of motion of the displaceable member 52 upon deactivation of the actuator 50 ("a movement out of the actuator").

It is moreover possible to use an actuator, which in an abnormal operating state of the electrical appliance exerts pressing forces upon the end 42 in order to rotate the lever 38. In said case, in an abnormal operating state of the electrical appliance the actuator is to be supplied with energy in order to achieve the desired thermal expansion for rotation of the lever 38. To guarantee that in said case the actuator may effect a crossover of the blocking and release unit 12 into its release state even in the event of a total failure of the energy supply, an energy supply is required, which in such situations may independently supply energy. Such an energy supply may be provided e:g. by a suitably dimensioned storage capacitor, which is charged during normal operation of the electrical appliance.

If in the electrical appliance abnormal operating states may also arise, in which a release of the door lock 2 is not desirable or permissible, a non-illustrated release device for the emergency release unit 14 may be used. Such a release device in dependence upon parameters, which characterize the actual abnormal operating state of the electrical appliance, cooperates with the emergency release unit 14 in such a way that a release of the door lock 2 by the emergency release unit 14 may be prevented. In the present case, the release device may comprise e.g. a lever or pin, which in such operating states mechanically prevents a crossover of the emergency release unit 14 from its working state into its idle state. Depending on the used embodiment of the emergency release unit 14, the release device may in dependence upon the actual abnormal operating state either hold the emergency release unit 14 in its working state through suitable activation or prevent activation of said unit. For operation of the release device it may be necessary to use an energy supply device which, in a comparable manner to the energy supply of the last-described embodiment, may supply energy to the emergency release unit 14 independently of an energy supply for the electrical appliance.

In the embodiment, which is illustrated in FIGS. 2*a* to 2*d* and shown in a mirror-inverted manner in relation to the views of FIGS. 1*a* to 1*d*, the components corresponding to the previously described components are provided with identical reference characters. Said embodiment differs from the previous one in that the emergency release unit 14 comprises an actuating element 54, which is connected by a joint 56 to the end 40.

Fastened to the opposite end of the actuating element 54 to the joint 56 is a pin 58, which is disposed at right angles to the drawing plane. A spring 60 generates a rotatory force, which acts in an anticlockwise direction upon the actuating element 54, and a pressing force acting into the drawing plane. The pressing force may alternatively be provided by an elastic deformation of the actuating member 53 and/or of the lever 38.

Said embodiment further comprises a connecting link guide 62, which is provided e.g. on a fastening frame for the emergency release unit 14. The connecting link guide 62 diagrammatically illustrated in FIG. 3 has a non-designated recess, which comprises a substantially horizontally extending guide channel 64 and, connected thereto, a substantially vertically extending guide channel 66, which verges into a guide channel 68, which extends in a curved manner and additionally connects the guide channels 64 and 66. The curved guide channel 68 comprises a slope 70, which extends from the plane of the guide channel 66 in a (gently) ascending manner up to an edge 72. A web 74, which is disposed in the recess, together with the edge 72 forms a marginal boundary of the guide channel 64. The arrows shown in FIG. 3 indicate the directions of motion of the pin 58 in the connecting link guide 62 during operation of the emergency release unit 14.

Figure 2A:
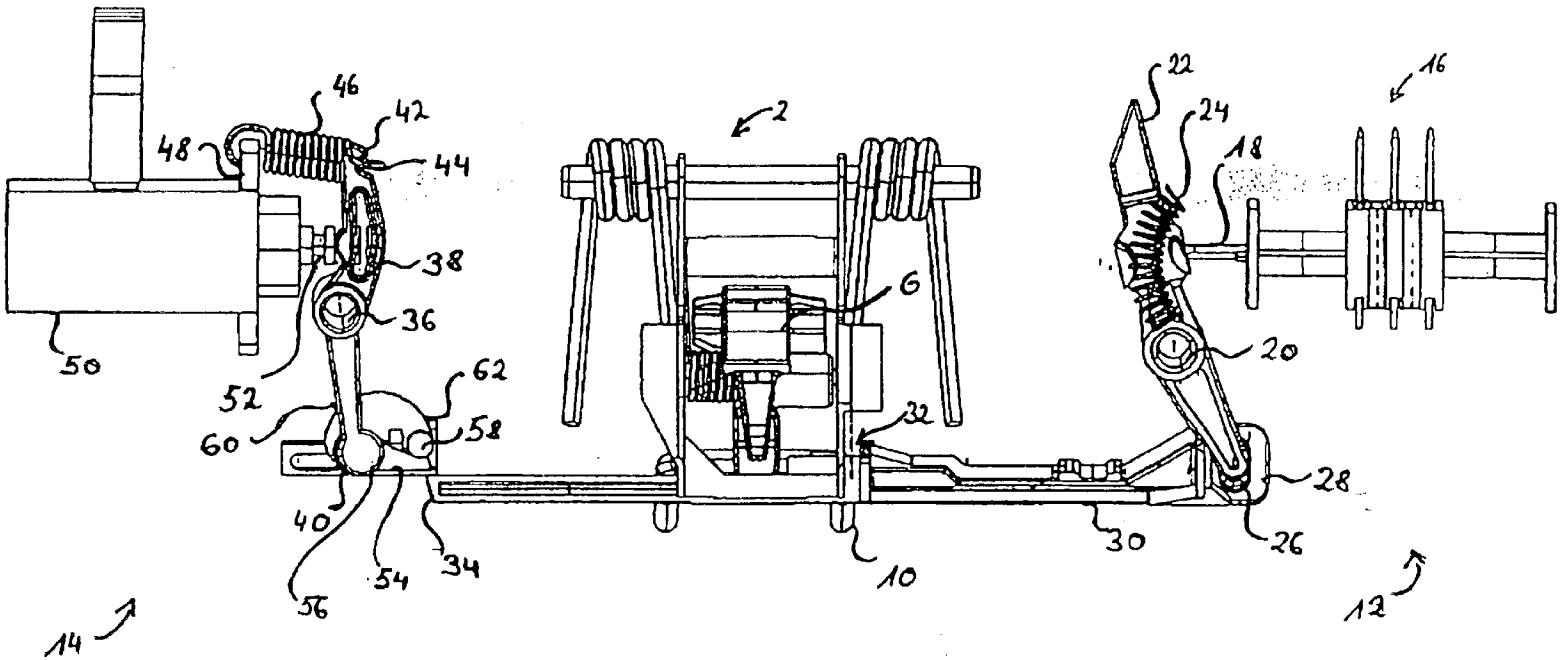

In the state shown in FIG. 2*a* the door lock 2 is unlocked, wherein the blocking and release unit 12 is situated in the release state and the emergency release unit 14 is situated in the idle state. In said case, the pin 58 is situated at the position denoted by I in FIG. 3.

Figure 2B:
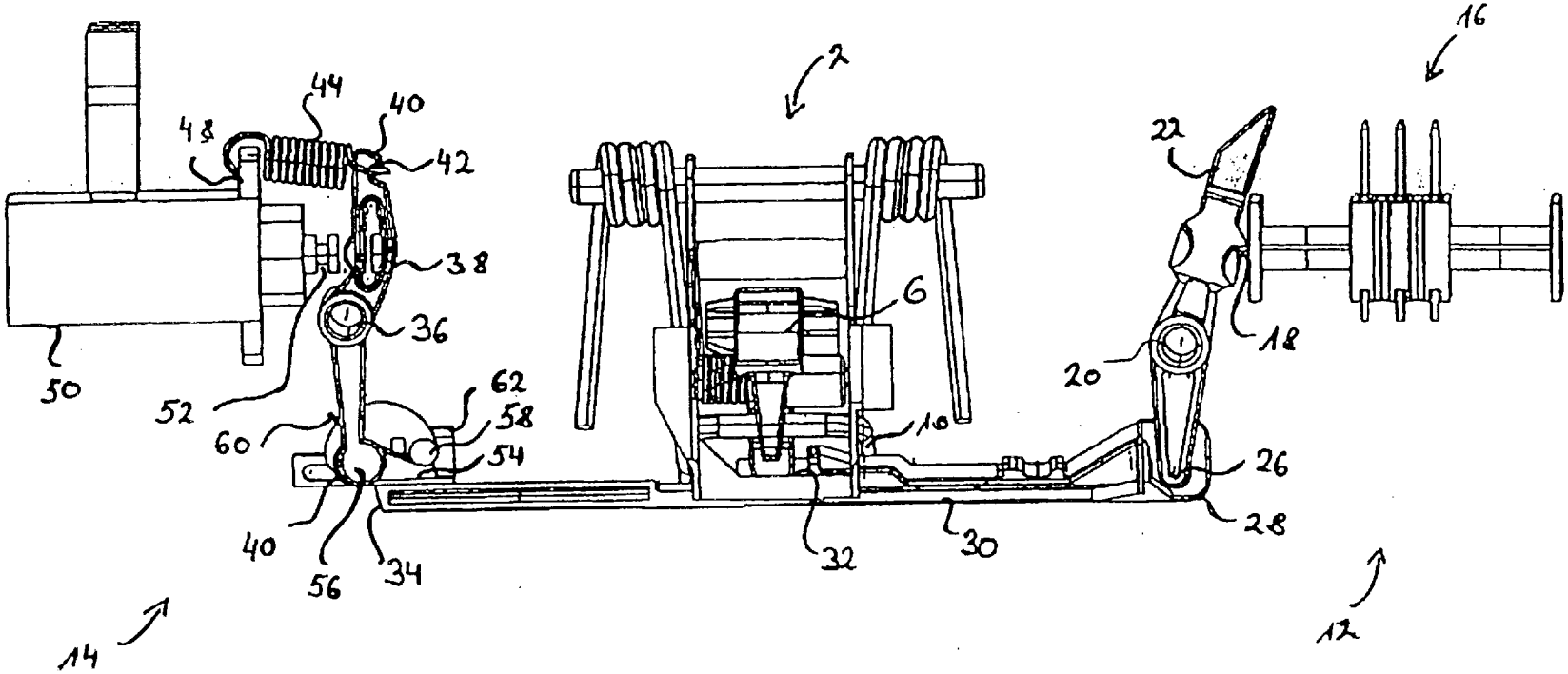

FIG. 2*b* shows a state, in which the door lock 2 is locked and the blocking and release unit 12 is situated in its blocking state. Here, in contrast to the embodiment described with reference to FIGS. 1*a* to 1*d*, the crossover of the blocking and release unit 12 into the blocking state does not cause an actuation of the lever 38. Rather, here the lever 38 is rotated when the displaceable member 52 has moved to the right because of activation of the actuator 50.

Figures 2C, 3:
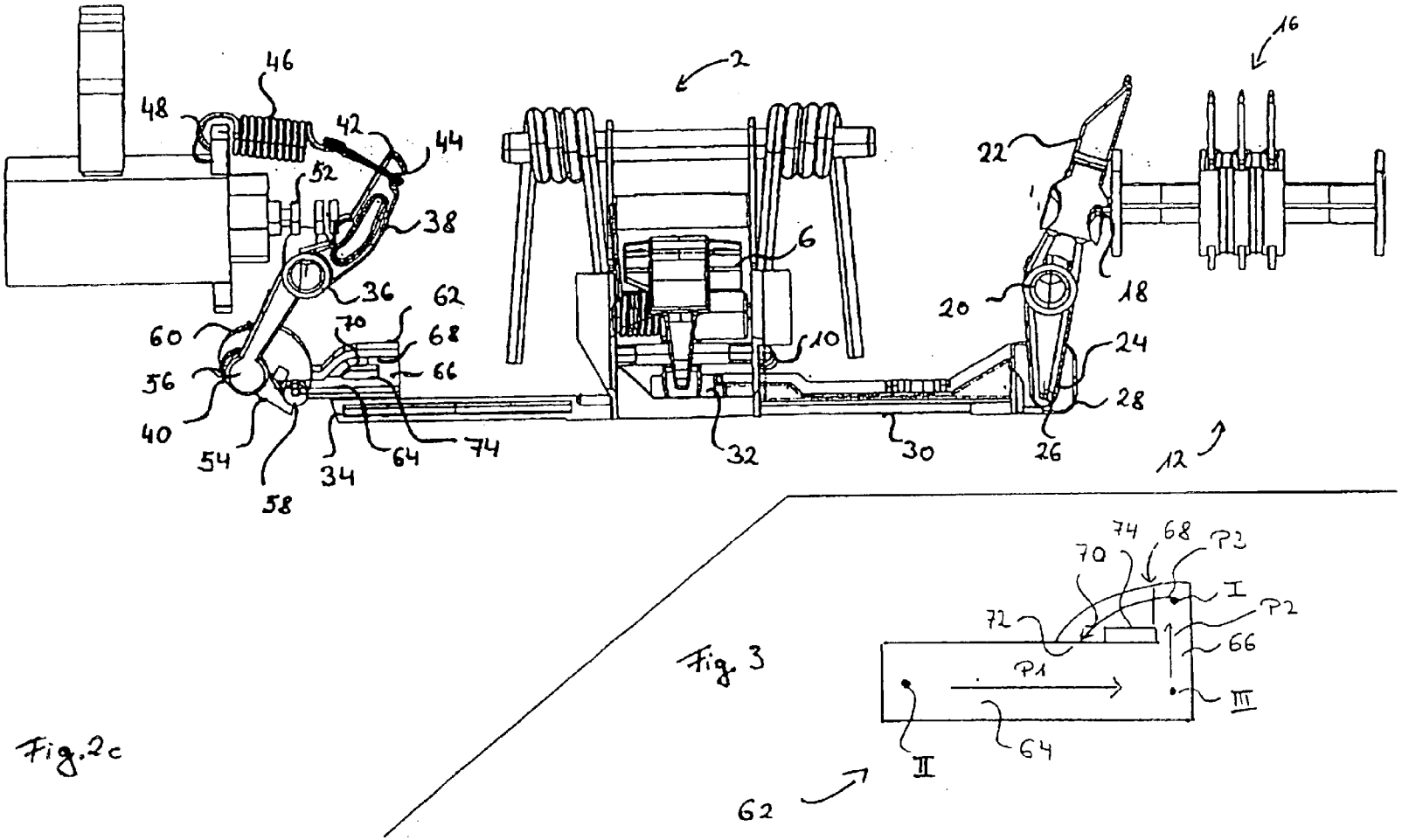
Figure 2D:
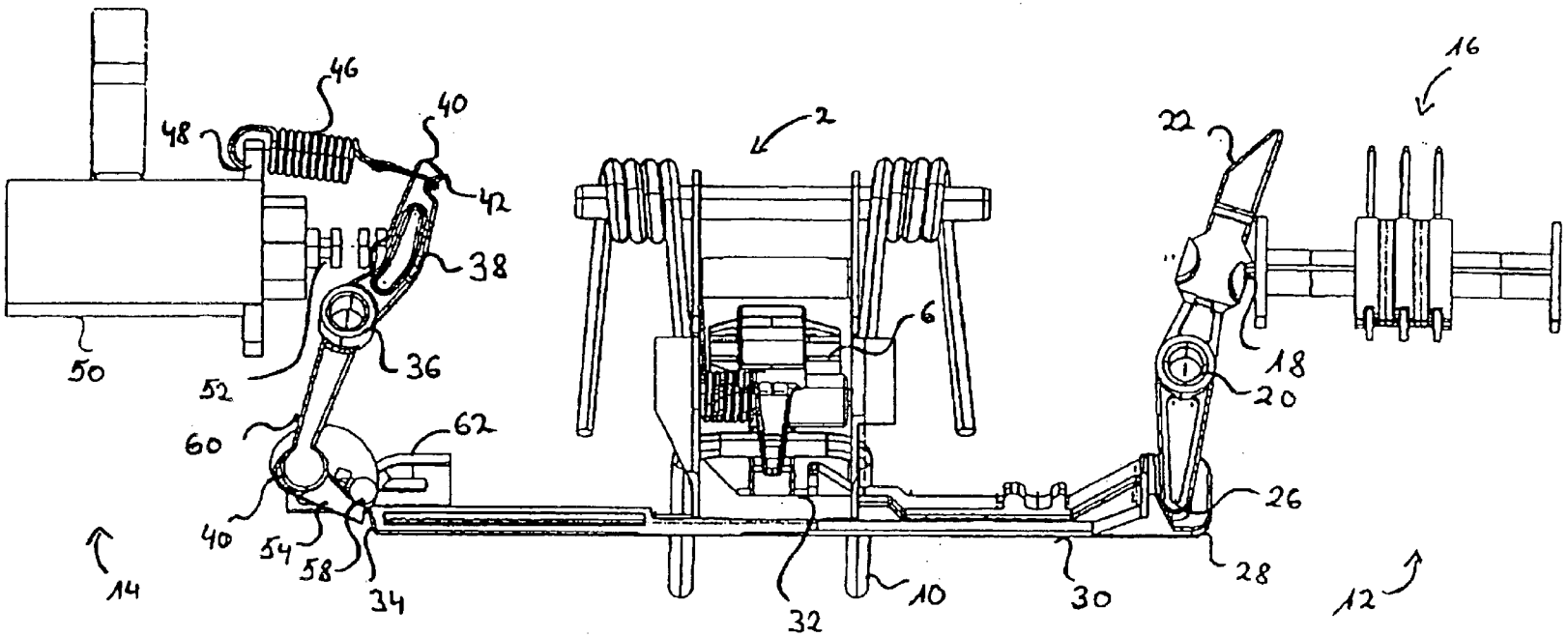

A movement of the displaceable member 52 effects a rotation of the lever 38 in clockwise direction, wherein the pin 58 is moved in the curved guide channel 68 from the position I in the direction indicated by the arrow P1 to the position II (see FIG. 3). During said movement the pin 58 is guided by the slope 70 up to the edge 72, behind which it jumps on account of the pressing force of the spring 60 onto the plane of the base surface of the guide channel 64. When the pin 58 is situated at the position II shown in FIG. 3, the emergency release unit 14 has crossed over into its working state shown in FIG. 2*c*.

During normal operation of the electrical appliance the door lock 2 is, as described above, released for unlocking because of a crossover of the blocking and release unit 12 into the release state. A crossover of the emergency release unit 14 into its idle state owing to an interruption/termination of its energy supply, in combination with the connecting link guide 62, causes a movement of the actuating element 54, which corresponds to the movement of the actuating element 54 described below for an abnormal operating state of the electrical appliance. In said case, unlike the subsequently described release of the door lock 2 in an abnormal operating state of the electrical appliance, the movement of the actuating element 54 does not effect a release.

As described above, in an abnormal operating state of the electrical appliance the energy supply of the actuator 50 is interrupted/terminated so that, because of the resultant cooling, the displaceable member 52 is moved to the left by the tension spring 46. The lever 38 is accordingly rotated anticlockwise, with the result that the actuating element 54 is moved by the pin 58, which is guided in the guide channel 64, in the direction of the part P1 shown in FIG. 3 in the direction of the position III. During said movement, as may be seen in FIG. 2*d*, the actuating element 54 contacts the end 34 of the blocking and release element 30 and moves the latter to the right. Once the working connection between the actuating element 54 and the end 34 has been established, the further movement of the actuating element 54 towards the position III (see FIG. 3) effects a crossover of the blocking and release unit 12 into its release state, as described above.

Because of the boundary of the guide channel 64 formed by the edge 72 and by the web 74, the pin 58 is guided in said guide channel to the position III. When the pin 58 is situated at the position III, i.e. at the transition between the guide channel 64 and the guide channel 66, the spring 60 effects a rotation of the actuating element in an anticlockwise direction and hence a movement in the direction of the arrow P2 to the position I. The emergency release unit 14 is then situated in the idle state illustrated in FIG. 2*a*.

One advantage of said embodiment is that for blocking of the door lock 2 only the forces needed for actuating/moving the blocking and release unit 12 have to be generated by the electromagnetic actuator 16 and/or the spring 24. Forces needed for rotating the lever 38 counter to the action of the tension spring 46 are in said case not provided by the blocking and release unit 12. This may be advantageous in terms of the dimensioning of the electromagnetic actuator 16 and/or of the spring 24.

A further advantage is that the emergency release unit 14 operates substantially independently of the blocking and release unit 12. In said case, therefore, reliable blocking of the door lock 2 is guaranteed even when the emergency release unit 14 is not working properly, e.g. when because of a defect of the actuator 50 the working state is maintained.

Figure 4A:
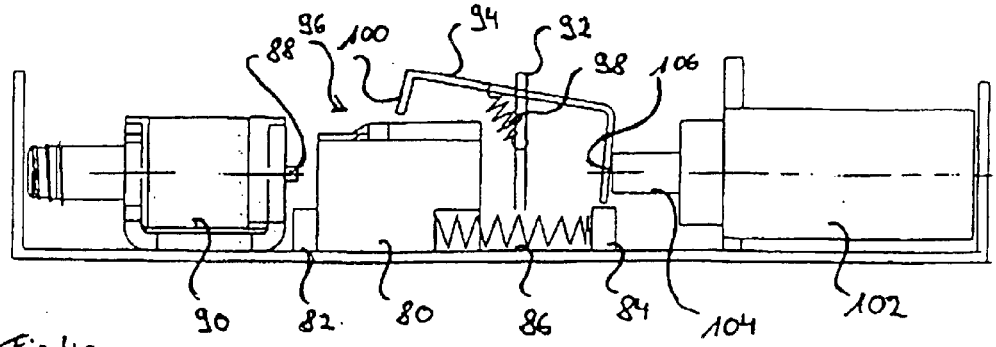
Figure 4B:
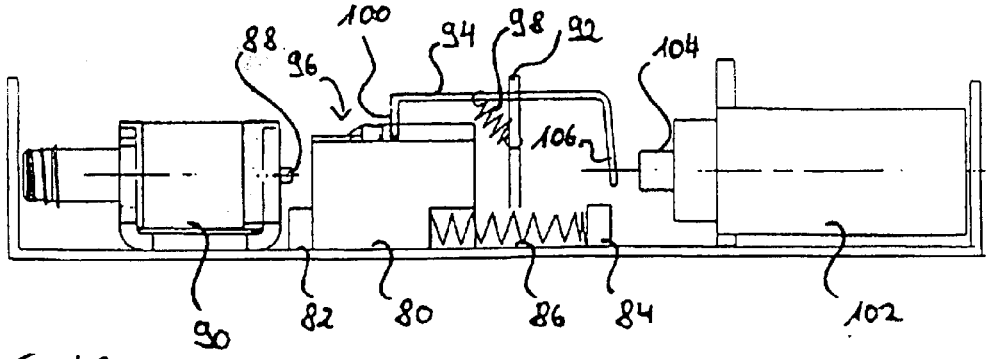
Figure 4C:
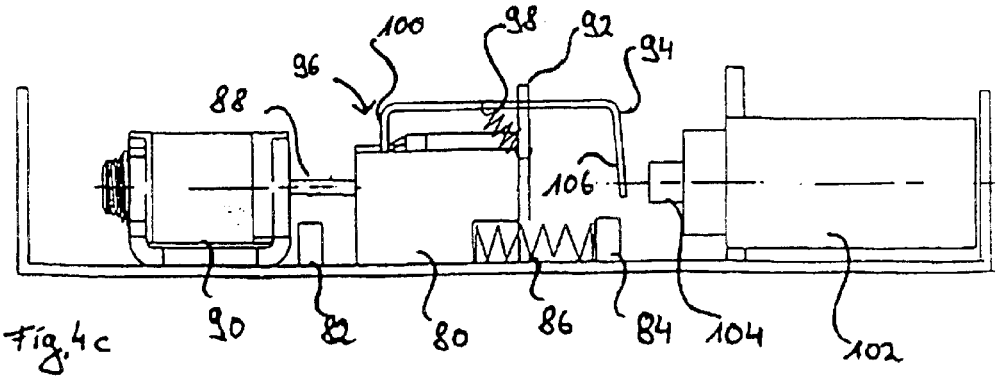
Figure 4D:
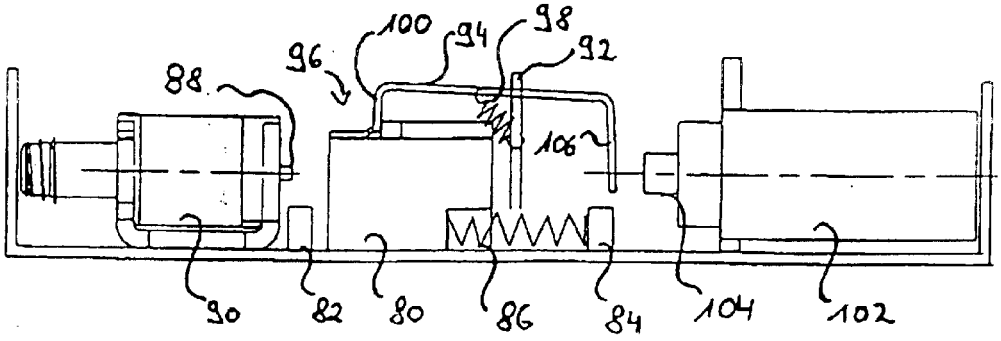
Figure 4E:
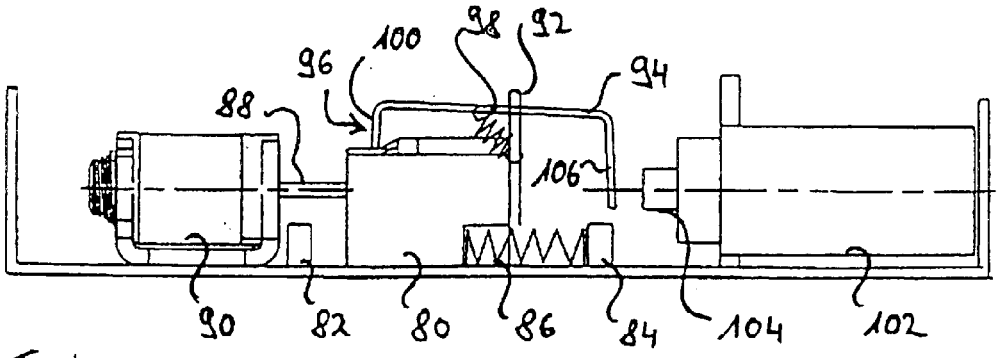
Figure 4F:
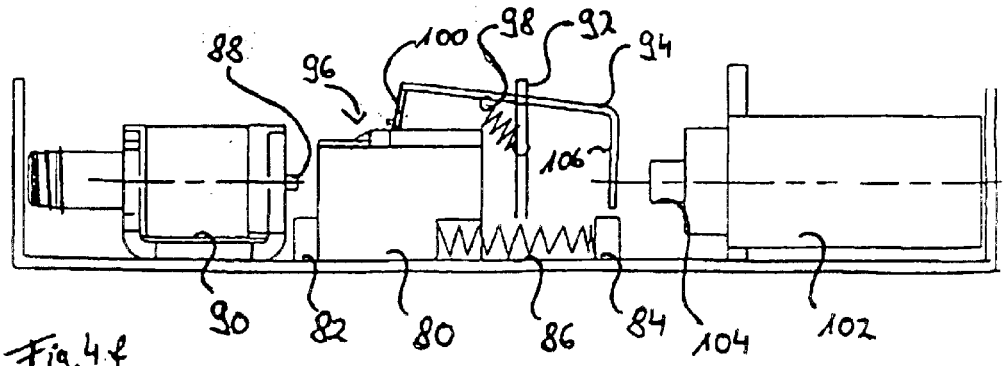

In the embodiment illustrated in FIGS. 4*a*–4*f*, the function of the blocking and release element 30 of FIGS. 1 and 2 is provided by a locking slide 80. In FIGS. 4*a*, 4*b* and 4*f* the locking slide 80 is situated in a release position, in which a door lock (not shown here) may be unlocked. In the release position the locking slide 80 contacts a stop 82, wherein a compression spring 86 disposed between the locking slide 80 and a further stop 84 secures the locking slide 80 in the release position. Here, said securing function of the compression spring 86 is only one feature because the compression spring 86, as described below, is also used to bring the locking slide 80 from a blocking position described below into the release position both during normal operation and during abnormal operation of an electrical appliance, in which said embodiment is used.

The locking slide 80 is displaceable and actuable by means of an actuating member 88 of an electromagnetic actuator 90. The function of the electromagnetic actuator 90 substantially corresponds to the function of the electromagnetic actuator 16 and is used to bring the locking slide 80 out of the release position into a blocking position shown in FIG. 4*d*.

A detent pawl 94, which is disposed movably and rotatably on an axle 92, cooperates with a connecting link guide 96 disposed at the top of the locking slide 80. The mode of operation of the detent pawl 94 and the connecting link guide 96 is described in greater detail below with reference to FIG. 5. The detent pawl 94 is connected to a tension spring 98, which exerts upon the detent pawl 94 forces which pull one end 100 of the detent pawl 94 in the direction of the surface of the locking slide 80 having the connecting link guide 96. The tension spring 98 is moreover disposed in such a way that its forces may effect, relative to the axle 92, a rotation of the end 100 in anticlockwise direction (i.e. a rotation of the end 100 into the drawing plane of FIGS. 4*a*–4*f* in the direction of the viewer).

In a comparable manner to the previous embodiments, the emergency release unit in said embodiment comprises a heat-sensitive, thermally activatable actuator 102 having a wax motor. The actuator 102 is connected to a displaceable member 104, which through contact with a, here angled, end 106 of the detent pawl 94 holds the latter in the position shown in FIG. 4*a*. In said case, the actuator 102 is situated in the previously described idle state and so the displaceable member 104 has assumed a neutral position. To achieve said neutral position, an actuator 102 and in particular a wax motor type are used, which in a non-activated state (i.e. in the event of a missing or interrupted energy supply) effect a movement of the displaceable member 104 into said position.

When the locked door lock (not shown here) is to be blocked for operation of the electrical appliance, the electromagnetic actuator 90 is activated so that the actuating member 88 moves the locking slide 80 to the right. The contact between the actuating member 88 and the locking slide 80 required for said purpose may in said case already exist in a non-activated state of the electromagnetic actuator 90 or be established, as illustrated, upon activation of the latter.

Furthermore, to block the door lock it is necessary for the actuator 102 to be activated, i.e. brought into its working state, in order to bring the displaceable member 104 into the working position shown in FIG. 4*b*. This leads to a working connection between the end 100 and the connecting link guide 96. In dependence upon the technical characteristics of the actuator 102 and in particular the length of time consequently taken to bring the displaceable member 104 into the working position, the instant of activation of the actuator 102 is to be selected relative to the activation instant for the electromagnetic actuator 90.

When the state shown in FIG. 4*b* exists, the electromagnetic actuator 90 pushes the locking slide 80 into the position shown in FIG. 4*c*, which lies further to the right than the blocking position of the locking slide 80 shown in FIG. 4*d*. Because of the connecting link guide 96, which is described further below, said movement of the locking slide 80 beyond the blocking position is necessary in order to establish a working connection between the end 100 and the connecting link guide 96, which holds the locking slide 80 in the blocking position according to FIG. 4*d*. Such a movement of the locking slide 80 may no longer apply when other suitable connecting link guides are used.

Once the electromagnetic actuator 90 has brought the locking slide 80 into the position, which is shown in FIG. 4*c* and may be defined e.g. by the length of the actuating member 88 and/or by a stop (not shown here), the electromagnetic actuator 90 is deactivated. The actuating member 88 accordingly releases the locking slide 80, which is moved by the compression spring 86 to the left and into the blocking position shown in FIG. 4*d*. In said case, the blocking position is maintained through cooperation of the end 100 of the detent pawl 94 with the connecting link guide 96.

In order during normal operation of the electrical appliance to release the door lock again for unlocking, the electromagnetic actuator 90 is activated once more. The actuating member 88 therefore moves the locking slide 80 from its blocking position to the right into the position shown in FIG. 4*e*. Because of the used connecting link guide 96 said position corresponds substantially to the position shown in FIG. 4*c*. Said movement of the locking slide 80 is also necessary here in order to achieve a working connection between the end 100 of the detent pawl 94 and the connecting link guide 96, which connection is needed for a crossover of the locking slide 80 from the blocking position into the release position.

When the locking slide 80 is in the position shown in FIG. 4*e*, the electromagnetic actuator 90 is deactivated and, as a result of a movement of the actuating member 88 to the right, the locking slide 80 is released. Once the locking slide 80 has been released, the compression spring 86 moves the locking slide 80 to the left, wherein because of the design of the connecting link guide 96 the detent pawl 94 assumes the position shown in FIG. 4*f*, which is needed here for a crossover of the locking slide 80 into the release position.

In the state illustrated in FIG. 4*f* the door lock is released for unlocking. As mentioned above with reference to the actuator 50, the actuator 102 is deactivated substantially at the same time or after a defined length of time. This causes a movement of the displaceable member 104 to the left, thereby resulting in the state shown in FIG. 4*a*.

In order in an abnormal operating state of the electrical appliance to release the locked door lock for unlocking, i.e. effect a crossover from the state shown in FIG. 4*d* into the state shown in FIG. 4*a*, the actuator 102 is used. In dependence upon the actually existing abnormal operating state of the electrical appliance the actuator 102 is deactivated. Said deactivation may arise, e.g. in the event of a power failure, inherently from the abnormal operating state or may be effected in a controlled manner if, for example, an faulty operating sequence has occurred, in which an unlocking of the door lock is necessary or desirable.

The deactivation of the actuator 102 leads to a displacement of the displaceable member 104 to the left.

In said case, the displaceable member 104 actuates the end 106 of the detent pawl 94 in such a way that the latter is brought from the position shown in FIG. 4*d* into the position shown in FIG. 4*a*. Said change of position of the detent pawl 94 effects a release of the locking slide 80 in the absence of a working connection between the end 100 and the connecting link guide 96. The compression spring 86 accordingly moves the locking slide 80 into its release position, with the result that the state shown in FIG. 4*a* is attained. In said state the door lock is released and may be unlocked.

Figure 5:
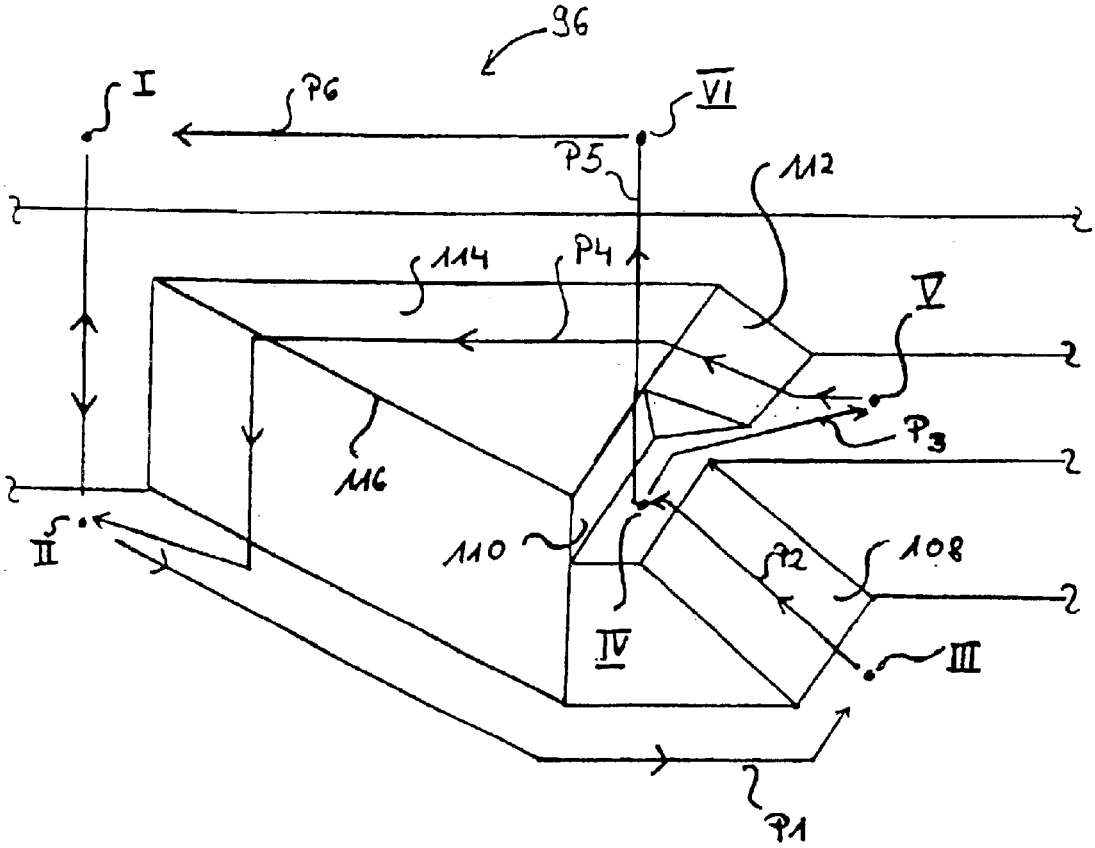

There now follows a detailed description of the connecting link guide 96 with reference to FIG. 5. The arrows shown in FIG. 5 represent movements of the end 100 of the detent pawl relative to surfaces of the connecting link guide 96.

Starting from the state shown in FIG. 4*a*, the end 100 is situated at the position I. An activation of the actuator 102 effects a movement of the end 100 to the position II, from which the end 100 reaches the position III along the arrow P1 because of an activation of the electromagnetic actuator 90 and the resultant movement of the locking slide 80. The end 100 is situated at the position III when the locking slide 80 is situated in the position shown in FIG. 4*c*. As a result of deactivation of the electromagnetic actuator 90 the locking slide 80 is brought by the compression spring 86 into the position shown in FIG. 4*d*, which according to FIG. 5 leads to a movement of the connecting link guide 96 to the right. In said case, the end 100 of the detent pawl 94 moves over an oblique surface 108 to the position IV, where it contacts a surface 110 defining a catch. Because of the working connection between the catch 110 and the end 100 the locking slide 80 is held in the blocking position.

For a crossover of the locking slide 80 into the release position the electromagnetic actuator 90 is, as described above, activated once more. The result is a movement of the connecting link guide 96 according to FIG. 5 to the left, wherein the tension spring 98 rotates the detent pawl 94 about the axle 92. The end 100 accordingly moves relative to the connecting link guide along the arrow P3 to the position V. The subsequent deactivation of the electromagnetic actuator 90 releases the locking slide 80, which because of the force generated by the compression spring 86 leads according to FIG. 5 to a movement of the connecting link guide 96 to the right. In said case, the end 100 of the detent pawl 94 moves along the arrow P4 over an oblique surface 112 and a substantially horizontally illustrated surface 114 up to an edge 116. Because of the tensile forces generated by the tension spring 98, the end 100 "jumps" downwards after the edge 116 and, because of the movement of the locking slide 80, reaches the position II. The deactivation of the actuator 102 effects a movement of the end 100 from the position II into the position I.

For a release of the door lock in an abnormal operating state of the electrical appliance the actuator 102 is, as described above, deactivated in order to actuate the detent pawl 94. Because of the blocking of the door lock effected by the electromagnetic actuator 90, the end 100 of the detent pawl is situated at the position IV. The actuation of the detent pawl 94 by the deactivated actuator 102 causes a movement of the end 100 in the direction of the arrow P5 to the position VI. Because of the movement of the locking slide 80 under the action of the compression spring 86, the end 100 is moved relative to the connecting link guide in the direction of the arrow P6 up to the position I.

One advantage of the embodiment described with reference to FIGS. 4*a*–4*f* is that to maintain the blocking state, i.e. the blocking position of the locking slide 80, it is not necessary to hold the electromagnetic actuator 90 in an activated state and/or use a device providing the function of the previously described bistable element 22.

What is claimed is:

1. An apparatus for blocking and releasing a door lock of an electrical appliance, comprising:

a blocking and release unit having a blocking state for blocking a locked door lock of an electrical appliance and a release state for enabling unlocking of the door lock and comprising an actuator, which effects, upon activation, a crossover from the release state to the blocking state if the blocking and release unit is in the release state and a crossover from the blocking state to the release state if the blocking and release unit is in the blocking state, and an emergency release unit having an idle state and a working state and comprising an actuator, which effects, in response to the crossover of the blocking and release unit into the blocking state, a crossover from the idle state into the working state and allows, in an abnormal operating state of the electrical appliance, a crossover from the working state into the idle state, wherein the emergency release unit in the event of the crossover from the working state into the idle state brings the blocking and release unit into the release state, and wherein the emergency release unit includes a spring as a force generating element for effecting the crossover from the working state into the idle state.

2. Apparatus according to claim 1, wherein the emergency release unit effects the crossover from the idle state into the working state.

3. An apparatus for blocking and releasing a door lock of an electrical appliance, comprising:

a blocking and release unit having a blocking state for blocking a locked door lock of an electrical appliance and a release state for enabling unlocking of the door lock and comprising an actuator, which effects, upon activation, a crossover from the release state to the blocking state if the blocking and release unit is in the release state and crossover from the blocking state to the release state if the blocking and release unit is in the blocking state, and an emergency release unit having an idle state and a working state and comprising a force-generating element, which effects, in response to the crossover of the blocking and release unit into the blocking state, a crossover from the idle state into the working state and an actuator, which effects, in an abnormal operating state of the electrical appliance, a crossover from the working state into the idle state, wherein the emergency release unit in the event of the crossover from the working state into the idle state brings the blocking and release unit into the release state, and wherein the emergency release unit includes a spring as a force generating element for effecting the crossover from the working state into the idle state.

4. Apparatus according to claim 3, wherein the emergency release unit comprises an energy supply device for the actuator of emergency release unit, which device is designed to supply energy to the actuator of emergency release unit for activating the latter in the event of abnormal operation of the electrical appliance.

5. Apparatus according to claim 1 or 3, wherein the blocking and release unit assumes the blocking state by means of a working connection to the door lock in response to the locking of the latter.

6. Apparatus according to claim 1 or 3, wherein the blocking and release unit in a locked state of the door lock assumes the blocking state in a controlled manner.

7. Apparatus according to claim 1 or 3, wherein the blocking and release unit assumes the release state in an operating state of the electrical appliance, for which an unlocking of the door lock is desirable and/or permissible.

8. Apparatus according to claim 1 or 3, wherein the emergency release unit assumes the working state by means of a working connection to the blocking and release unit in response to the crossover of the latter into the blocking state.

9. Apparatus according to claim 1 or 3, wherein the emergency release unit assumes the working state in a controlled manner when the blocking and release unit is situated in the blocking state or before the blocking and release unit assumes the blocking state.

10. Apparatus according to claim 1 or 3, wherein during normal operation of the electrical appliance the emergency release unit assumes the idle state in response to the crossover of the blocking and release unit from the blocking state into the release state.

11. Apparatus according to claim 1 or 3, wherein the actuator of the emergency release unit is a heat-sensitive element, a thermoelement or a wax motor.

12. Apparatus according to claim 1 or 3, further comprising a release device for the emergency release unit, which device in dependence upon parameters characterizing an abnormal operating state of the electrical appliance allows a crossover of the emergency release unit into an idle state.

13. Apparatus according to claim 1 or 3, further comprising a connecting link guide.

14. Apparatus according to claim 1 or 3, further comprising a connecting link guide, wherein the emergency release unit comprises an actuating element engaging the connecting link guide.

15. Apparatus according to claim 1 or 3, further comprising a connecting link guide, wherein the emergency release unit comprises an actuating element engaging the connecting link guide and the blocking and release unit comprises a blocking and release element, the actuating element engaging the blocking and release element during the crossover from the working state into the idle state.

16. Apparatus according to claim 1 or 3, further comprising a connecting link guide, wherein the emergency release unit comprises a detent pawl engaging the connecting link guide in the working state and releasing the connecting link guide in the idle state.

17. Apparatus according to claim 1 or 3, further comprising a connecting link guide, wherein the blocking and release unit comprises a locking slide and the connecting link guide is arranged on the locking slide.

18. Apparatus according to claim 1 or 3, further comprising a connecting link guide, wherein the blocking and release unit comprises a locking slide, the connecting link guide is arranged on the locking slide and the emergency release unit comprises a detent pawl engaging the connecting link guide in the working state and releasing the locking slide in the idle state.

* * * * *